US005816916A

United States Patent [19]

Moody

[11] Patent Number: 5,816,916

[45] Date of Patent: Oct. 6, 1998

[54] VIDEO POKER GAME

[76] Inventor: Ernest W. Moody, 4381 Pebble Beach Dr., Niwot, Colo. 80503

[21] Appl. No.: 911,474

[22] Filed: Aug. 14, 1997

[51] Int. Cl.[6] ..... A63F 1/00

[52] U.S. Cl. ..... 463/13; 273/292

[58] Field of Search ..... 273/292, 274, 273/309; 463/12, 13

[56] References Cited

U.S. PATENT DOCUMENTS

| | | | |
|---|---|---|---|
| 5,265,882 | 11/1993 | Malek | 273/292 |
| 5,328,189 | 7/1994 | Malek | 273/292 |
| 5,377,993 | 1/1995 | Josephs | 273/292 |
| 5,496,038 | 3/1996 | Kangsanaraks | 273/292 |
| 5,577,731 | 11/1996 | Jones | 273/292 |
| 5,591,081 | 1/1997 | Suzuki | 463/13 |
| 5,639,092 | 6/1997 | Macaisa | 273/292 |

OTHER PUBLICATIONS

Hoyle's Modern Encyclopedia Of Card Games, Walter B. Gibson, Doubleday & Company, Inc., "Butcher Boy", p. 245, Klondike Solitaire, pp. 338–339, 1974.

*Primary Examiner*—Benjamin H. Layno
*Attorney, Agent, or Firm*—John Edward Roethel

[57] ABSTRACT

The method commences with dealing the player an initial five card poker hand from a standard deck of playing cards and the cards are displayed in five locations on the video display screen. Any cards from the initial deal of five cards that match in card rank are grouped together and stacked on top of each other and positioned at a single card location. Replacement cards for these matching cards are then dealt from the standard deck of playing cards so that all five card locations of the initial deal of the cards are filled. If any of the replacement cards match in card rank, again the cards are grouped together and still more replacement cards are dealt until all five card locations have cards or groups of cards of different ranks. The initial deal stops when the last card dealt does match any of the existing cards. The player then selects which of the cards in the five locations he wishes to discard and which he wishes to hold. Replacement cards for the discarded cards are then dealt and displayed to the player. The final hand is determined using all of the cards shown on the display screen including the stacked cards. Poker hand rankings are used to determine winning hand combinations and a payout schedule is provided to award the player based on a winning hand combination achieved. This method provides the player a greater number of draw poker options to achieve a winning five card poker hand.

15 Claims, 5 Drawing Sheets

VIDEO POKER GAME

CROSS-REFERENCE TO RELATED APPLICATION

This application is a Continuation-in-Part of application Ser. No. 60/023,670, entitled "Video Poker Game", filed Aug. 15, 1996, now pending.

BACKGROUND OF THE INVENTION

This invention relates primarily to electronic video poker games, and more particularly to electronic video poker games that are based on draw poker. Conventional video draw poker is a single player game in which the player does not play against a dealer or other players, but rather merely tries to achieve the highest possible ranking poker hand. After an initial deal of five cards, the player is allowed to discard and replace unwanted cards with replacement cards. Electronic video poker games use poker hand rankings to determine winning combinations and a payout schedule is used to determine the amount awarded to the player for achieving a winning combination. The present invention has many variations based on the common thread that any cards from the initial deal that match in card rank are stacked together and counted as one card during the initial stage of the play of the game.

The conventional poker hand rankings that are used in video poker in order from highest to lowest are: Royal Flush, Straight Flush, Four of a Kind, Full House, Flush, Straight, Three of a Kind, Two Pair and a Pair of Jacks or better. Any hand having less than a Pair of Jacks or better is a losing hand.

Conventional video poker in a draw poker has been played in gaming casinos now for many years. Variations of conventional video draw poker have evolved and include video draw poker using Jokers as wild cards and video draw poker using Deuces (or even Sevens) as wild cards. Most of the more recent modifications to video involve changes to the pay table such as Bonus Poker, Double Bonus Poker, Double-Double Bonus Poker and even Triple Bonus Poker. However, these pay table variations that have been developed still use the standard video draw poker format of dealing five cards, holding the desired cards and discarding the undesired cards and drawing replacement cards for the discarded cards. As the patrons become bored with these variations of conventional video draw poker, gaming casinos are continually looking for new video poker games to entice players and increase player participation.

It is an object of the present invention to provide a novel and attractive video draw poker method of play that will create interest and provide an attraction to video draw poker.

It is a feature of the present invention to provide a method of play of video draw poker in which matching cards from the initial deal are stacked at a single location and additional cards are dealt into the spaces vacated by the stacked cards. The player may then hold, discard and draw replacement cards to complete a final hand. Winning card combinations based on the best five card hand formed from the final hand are awarded a payout.

It is an advantage of the present invention that, when matching cards are dealt on the initial hand, the player is given more than five cards from which to form a winning hand combination. This improves the player's chances for obtaining a winning hand combination and increases the player's interest in the game.

SUMMARY OF THE INVENTION

The method of the present invention commences with dealing the player an initial five card poker hand from a standard deck of playing cards and the cards are displayed in five locations on the video display screen. Any cards from the initial deal of five cards that match in card rank are grouped together and stacked on top of each other and positioned at a single card location. Replacement cards for these matching cards are then dealt from the standard deck of playing cards so that all five card locations of the initial deal of the cards are filled. If any of the replacement cards match in card rank, again the cards are grouped together and still more replacement cards are dealt until all five card locations have cards or groups of cards of different ranks. The initial deal stops when the last card dealt does match any of the existing cards. The player then selects which of the cards in the five locations he wishes to discard and which he wishes to hold. Replacement cards for the discarded cards are then dealt and displayed to the player. The final hand is determined using all of the cards shown on the display screen including the stacked cards. Poker hand rankings are used to determine winning hand combinations and a payout schedule is provided to award the player based on a winning hand combination achieved. This method of play provides the player a greater number of draw poker options to achieve a winning five card poker hand.

DETAILED DESCRIPTION OF THE PREFERRED EMBODIMENTS

Figure 1:
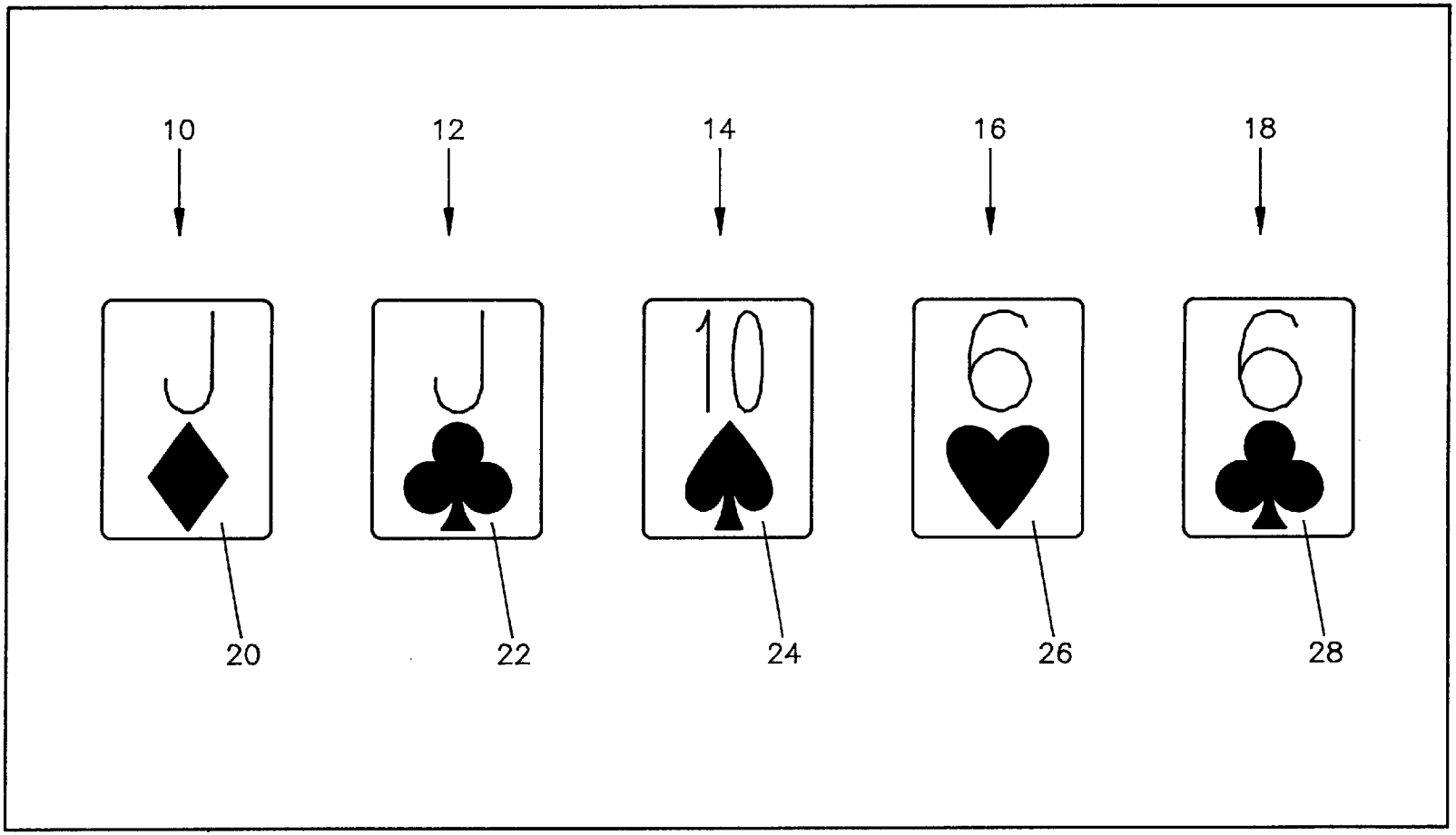
FIG. 1 shows the screen display for the present invention after the initial deal of the first five cards.

The present invention includes a variety of electronic video poker games that are based on the feature of stacking cards that match in card rank and dealing extra cards for the cards that have been stacked. Each electronic video poker game is designed to be played by having cards from a standard deck of playing cards displayed to a player as a hand on a video screen. By manipulating the conventional electronic video poker machine buttons on a panel of the gaming device or by using conventional touch screen technology, the player selects which cards or which group of cards he wishes discard. Replacement cards are then dealt from the standard deck of playing cards and are displayed in place of the discarded cards and the outcome of the play of the hand is determined based on the cards displayed after the draw step.

VERSION #1

Super Stack Poker

Five cards are dealt face up from a standard deck of playing cards. These five cards are displayed on a video screen in any suitable arrangement. In the preferred embodiment, the initial deal of the five cards are arranged so that there are five separate card locations displayed horizontally across the video screen. Any cards that match in card rank are then electronically stacked on top of each other in a column on the video screen display so that all of the stacked cards are visible and each resulting stack of cards is treated as one card location. Additional cards are then dealt and displayed in the empty card locations to replace the cards that have been stacked. If the additional cards match by card rank any of the cards in the hand, they are also stacked and more cards are dealt until the player has cards or groups of cards at each of the five card locations with each stacked column counting as one card location. If the initial deal of five cards does not include any matching ranked cards, the player receives only those first five cards.

As an alternative method of dealing, cards are dealt one at a time and displayed on the video screen. The first card is displayed at the first card location. The second card is dealt and if it matches the first card in rank, it is stacked in the first card location. If the second card does not match the first card in rank, it is displayed at the second card location.

The initial deal of the cards continues with any matching cards by rank being stacked at the matching card location and the non-matching cards being placed in their own separate card location. The initial deal of the cards continues until all five card locations have a card or a group of cards.

The player then picks the cards he wants to discard and replacement cards are dealt and displayed for the discarded cards. The player may discard an entire stacked column, but if he does so, he only receives one replacement card in return. Matching replacement cards are not stacked.

After the player receives his replacement cards, he may unstack the columns to make a higher ranking hand by placing the stacked cards over other cards in the hand. In the preferred embodiment of the present invention in which the method of play is conducted on an electronic video poker machine, the computer software operating the poker machine will automatically unstack the cards to form the highest bill ranking video poker hand. Regardless of the number of cards that are available for use by the player after the discard and draw has occurred, the final poker hand achieved by the player is based on the best five card hand that can be made.

The resulting best five card hand is then evaluated and the player is paid according to a suitable pay table which is conventional in video poker games. The amounts shown in the pay table are based on the number of coins, tokens or credits wagered by the player and the type of poker hand ranking achieved using the best five cards remaining after the draw step. The payouts can be fixed amounts or flat jackpot amounts being multiples of the amount of the wager. Alternatively, progressive jackpots may be provided for winning combinations.

As a modification to the method of play described above, additional awards may also be paid to players that achieve two or more four of a kinds or even two or more three of a kinds.

An example of the method of play of the present invention is demonstrated beginning with FIG. 1. In FIG. 1, the initial deal of the cards is shown as single five card displayed in a horizontal row of cards with a first card location 10, a second card location 12, a third card location 14, a fourth card location 16 and a fifth card location 18. The player has been dealt an initial hand of five cards consisting of a Jack of Diamonds 20, a Jack of Clubs 22, a Ten of Spades 24, a Six of Hearts 26 and a Six of Clubs 28. In accordance with the method of play, any cards from the initial deal that match in card rank are stacked into a common card location.

Figure 2:
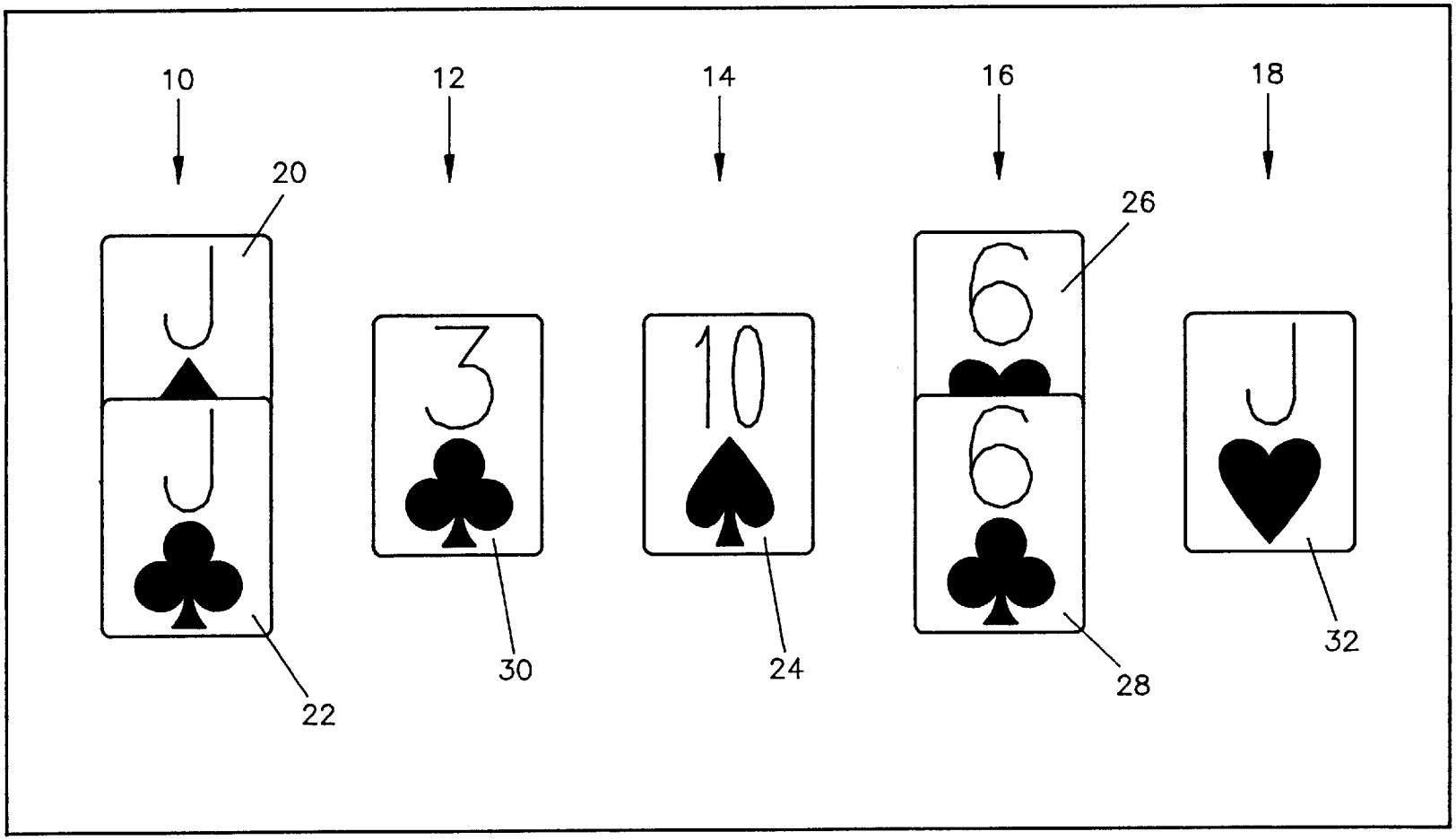
FIG. 2 shows the screen display after the matching ranked cards have been stacked and additional cards have been dealt.

FIG. 2 shows the resulting display of cards after matching ranked cards have been stacked. The matching Jack of Diamonds 20 and the matching Jack of Clubs 22 are stacked into common card location 10 (or alternatively into card location 12, if desired). The matching Six of Hearts 26 and the matching Six of Clubs 28 have been stacked into common card location 16 (or alternatively into card location 18, if desired). After this stacking has been performed, two additional cards, the Three of Clubs 30 and the Jack of Hearts, 32 have been dealt and displayed at the card locations 12 and 18, respectively, that were vacated when the matching ranked cards were stacked. The resulting display of FIG. 2 shows the five card locations with a total of seven cards.

Figure 3:
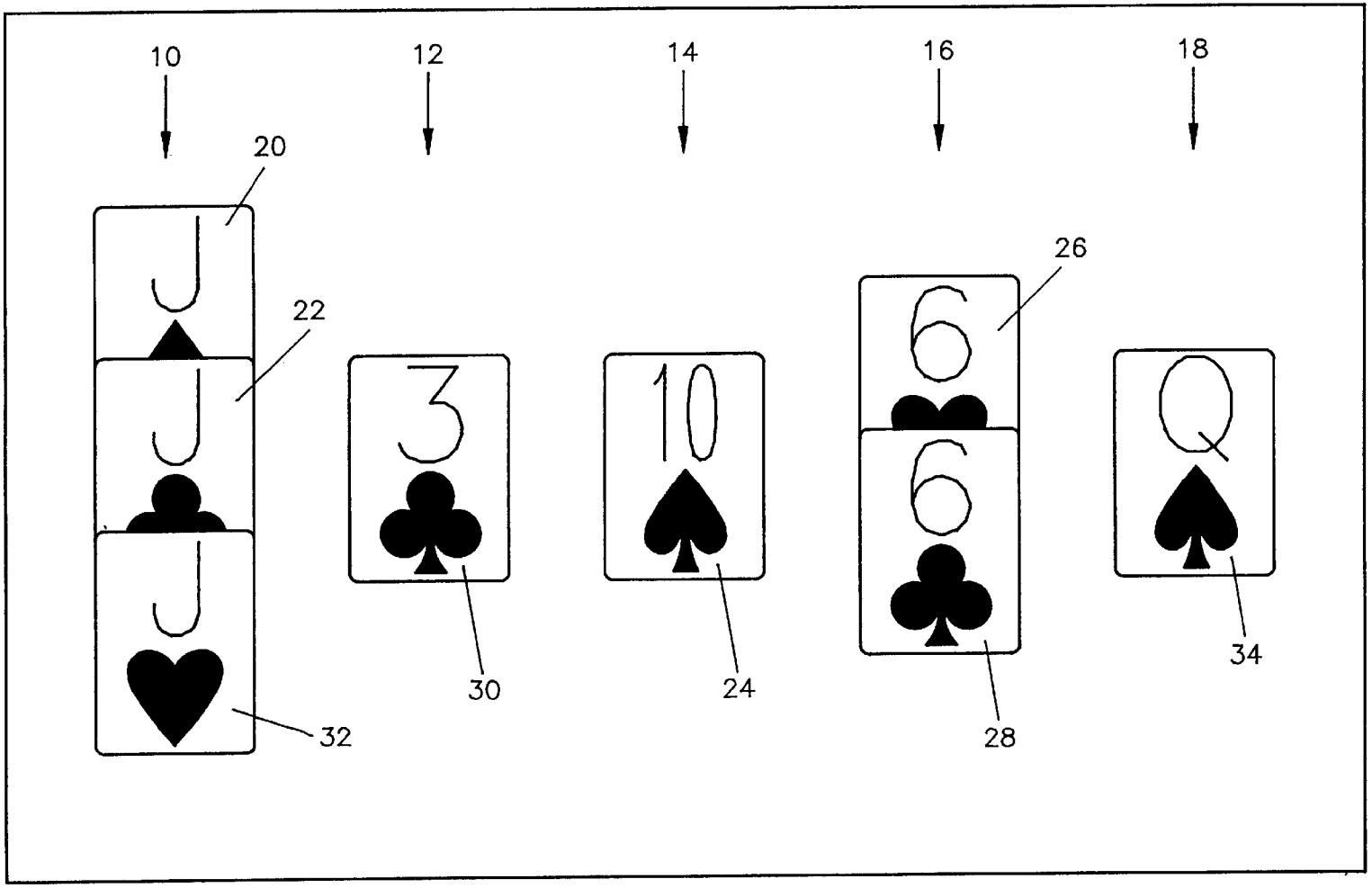
FIG. 3 shows the screen display after the another matching ranked card has been stacked and an additional card has been dealt.

In FIG. 3, the additional matching Jack of Hearts 32 has been stacked with the two other Jacks at common card location 10 and the Queen of Spades 34 has been dealt and displayed at the card location 18 vacated by the Jack of Hearts 32. Since there are now no cards that match in rank that have not been stacked, the initial deal of the cards is complete and the method of play continues to the draw step. Prior to the draw step, the display of the player's hand shows five card locations with a total of eight cards.

Figure 4:
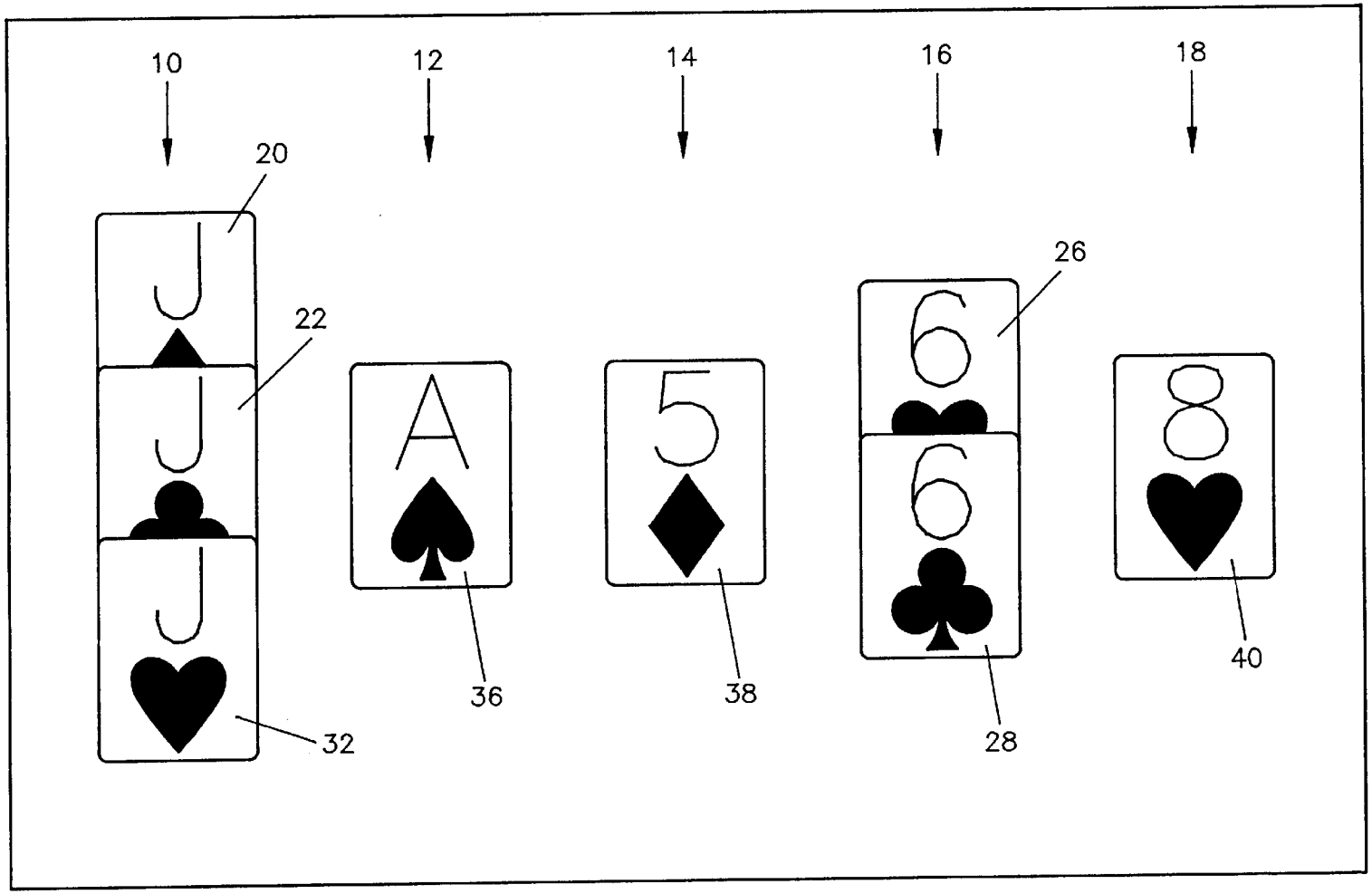
FIG. 4 shows the screen display after the player has discarded and drawn three new replacement cards.

In FIG. 4, the player has decided to hold the stacked columns of Jacks at card location 10 and the stacked column of Sixes at card location 16 and has discarded the other three cards. Replacement cards for the discarded cards have been dealt and displayed. The player has drawn as the three replacement cards the Ace of Hearts 36, the Five of Diamonds 38 and the Eight of Hearts 40, to replace the three unwanted cards that have been discarded. The three replacement cards have failed to improve the player's hand.

Figure 5:
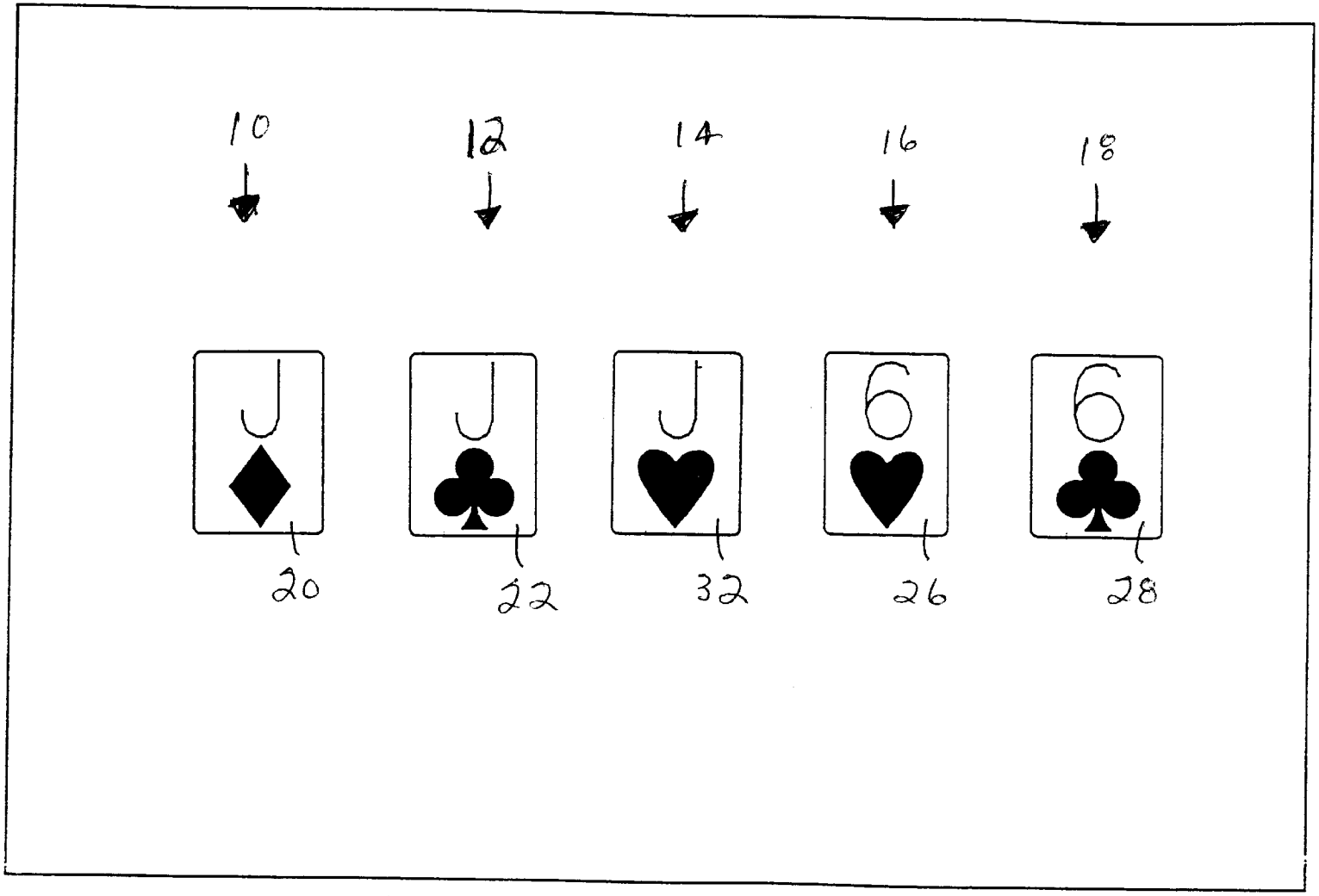
FIG. 5 shows the screen display after the stacked cards have been unstacked to make the best possible poker hand which is a full house.

FIG. 5 shows the final hand which will be used to determine whether a winning card combination has been achieved. As shown in FIG. 5, the column of Jacks and the column of Sixes have been unstacked to make the best possible hand which, in this case, is a Full House. The player is then paid an award for the hand based on a suitable video poker style pay table based on the number of coins, tokens or credits wagered by the player at the beginning of play of the hand.

VERSION #2

This version of the game is played the same way as Version #1 except that after the draw step in which the player discards the unwanted cards and replacement cards are dealt and displayed for the unwanted cards, the cards are again analyzed to determine if there are any additional matching rank cards. If so, then the matching rank cards occurring after the draw step are also stacked if they match each other or any of the held cards in rank. If additional matching occurs after the draw step, the matching cards are then stacked and the player would then receive additional replacement cards to replace the cards that have been stacked. At this point, all of the final cards are utilized to determined the highest ranking five card poker hand and payouts are awarded for achieving winning card combinations as displayed on the pay table based on the number of coins, tokens or credits wagered by the player.

While the method of play of the present invention has been described in connection with an electronic video gaming machine, the method of play could also be practiced using a live table game format in which a live dealer deals cards to each of the players at the gaming table.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

a) dealing an initial hand of five cards to five separate card locations and displaying each card face up at its own card location;

b) determining if any of the cards of the initial hand match in card rank with any other cards of the initial hand;

c) stacking any cards that match in rank at a common card location for each rank of cards that match;

d) dealing additional cards to vacant locations to replace those cards that were stacked and, if any of the additional cards that were dealt match in card rank with any other cards, stacking at a common card location any of the additional cards that match in rank and continuing to deal other additional cards to vacant locations to replace the cards that were stacked until all five card locations have at least one card;

e) allowing the player to discard any unwanted cards and dealing replacement cards for the discarded cards; and f) determining the highest ranking five card poker hand using all of the displayed cards.

2. The method of claim 1 further comprising the players making a wager to participate in the game and paying the player an award based on the amount of the wager if the highest ranking five card poker hand consists of a predetermined winning combination of cards.

3. The method of claim 2 in which the predetermined winning combinations are based on poker hand rankings.

4. The method of claim 2 further comprising paying the player an additional bonus payout if all of the displayed cards form two four of a kinds.

5. The method of claim 2 further comprising paying the player an additional bonus payout if all of the displayed cards form two three of a kinds.

6. A method of playing a card game comprising:

a) dealing an initial hand of five cards to five separate card locations and displaying each card face up at its own card location;

b) determining if any of the cards of the initial hand match in card rank with any other cards of the initial hand;

c) stacking any cards that match in rank at a common card location for each rank of cards that match;

d) dealing additional cards to vacant locations to replace those cards that were stacked and, if any of the additional cards that were dealt match in card rank with any other cards, stacking at a common card location any of the additional cards that match in rank and continuing to deal other additional cards to vacant locations to replace the cards that were stacked until all five card locations have at least one card;

e) allowing the player to discard any unwanted cards and dealing replacement cards for the discarded cards;

f) determining if any of the cards after discarding and receiving replacement cards match in card rank with any other cards;

g) stacking any cards that match in rank at a common card location for each rank of cards that match;

h) dealing additional cards to vacant locations to replace those cards that were stacked and, if any of the additional cards that were dealt match in card rank with any other cards, stacking at a common card location any of the additional cards that match in rank and continuing to deal other additional cards to vacant locations to replace the cards that were stacked until all five card locations have at least one card; and i) determining the highest ranking five card poker hand using all of the displayed cards.

7. The method of claim 6 further comprising the player making a wager to participate in the game and paying the player an award based on the amount of the wager if the highest ranking five card poker hand consists of a predetermined winning combination of cards.

8. The method of claim 7 in which the predetermined winning combinations are based on poker hand rankings.

9. The method of claim 7 further comprising paying the player additional bonus payouts if all of the displayed cards form two or more four of a kinds.

10. The method of claim 7 further comprising paying the player additional bonus payouts if all of the displayed cards form two or more three of a kinds.

11. A method of playing a card game comprising:

a) dealing a first card and displaying the first card face up at a first card location;

b) dealing a second card and, if the second card matches in rank to the first card, stacking the second card at the matching card location or, if the second card does not match in rank to the first card, displaying the second card at a second card location;

c) dealing additional cards and, if each of the additional cards matches any of a previous card in rank, stacking the additional card at the card location of the matching card or, if each of the additional cards does not match in rank any of the previous cards, displaying each additional card at its own card location until five card locations have at least one card displayed thereat;

d) allowing the player to discard any unwanted cards and dealing replacement cards for the discarded cards; and e) determining the highest ranking five card poker hand using all of the displayed cards.

12. The method of claim 11 further comprising the player making a wager to participate in the game and paying the player an award based on the amount of the wager if the highest ranking five card poker hand consists of a predetermined winning combination of cards.

13. The method of claim 12 in which the predetermined winning combinations are based on poker hand rankings.

14. The method of claim 12 further comprising paying the player additional bonus payouts if all of the displayed cards form two or more four of a kinds.

15. The method of claim 12 further comprising paying the player additional bonus payouts if all of the displayed cards form two or more three of a kinds.

* * * * *